US009743786B2

(12) United States Patent
Joebges

(10) Patent No.: US 9,743,786 B2
(45) Date of Patent: Aug. 29, 2017

(54) CONTAINER CAN AND HOLDING DEVICE

(71) Applicant: BALL EUROPE GMBH, Zurich (CH)

(72) Inventor: Udo Joebges, Dueren (DE)

(73) Assignee: Ball Europe GmbH, Zurich (CH)

( * ) Notice: Subject to any disclaimer, the term of this patent is extended or adjusted under 35 U.S.C. 154(b) by 0 days.

(21) Appl. No.: 15/021,597

(22) PCT Filed: Aug. 1, 2014

(86) PCT No.: PCT/EP2014/066602
§ 371 (c)(1),
(2) Date: Mar. 11, 2016

(87) PCT Pub. No.: WO2015/036167
PCT Pub. Date: Mar. 19, 2015

(65) Prior Publication Data

US 2016/0220049 A1 Aug. 4, 2016

(30) Foreign Application Priority Data

Sep. 13, 2013 (DE) ..... 20 2013 008 357 U

(51) Int. Cl.
*A47G 19/22* (2006.01)
*B65D 77/28* (2006.01)
(Continued)

(52) U.S. Cl.
CPC ..... *A47G 19/2222* (2013.01); *A47G 19/2272* (2013.01); *A47G 21/18* (2013.01);
(Continued)

(58) Field of Classification Search
CPC ..... A47G 19/2222; A47G 19/2272; A47G 19/2266; A47G 19/2205; A47G 21/18; B65D 77/283; B65D 85/73
(Continued)

(56) References Cited

U.S. PATENT DOCUMENTS 4,356,927 A 11/1982 Cooper et al.
4,892,187 A 1/1990 Stein
(Continued)

FOREIGN PATENT DOCUMENTS

AT 502989 7/2007
AT 10442 3/2009
(Continued)

OTHER PUBLICATIONS

International Search Report (with English translation) for International (PCT) Patent Application No. PCT/EP2014/066602, mailed Jan. 22, 2015, 10 pages.
(Continued)

*Primary Examiner* — Robert J Hicks
(74) *Attorney, Agent, or Firm* — Sheridan Ross PC

(57) ABSTRACT

The invention relates to a container can that is sealed after being filled, to a holding device for introduction into a container can, and to a method for manufacturing a container can. A container can according to the invention that has a bottom, a peripheral wall that adjoins the bottom, and a narrowed end on one end facing away from the bottom is characterized in that a two-part holding device is located in the container can that has a second part and a first part detachably connected thereto, of which the first part has a connecting section for connecting the second part to the first part as well as a plurality of support arms, at least two upper support arms of which are designed to be supported in the region of the narrowed end on the peripheral wall of the container can and at least two lower support arms of which are designed to be supported on the peripheral wall of the container can in a place that is nearer to the bottom of the container can than the connecting section is.

23 Claims, 8 Drawing Sheets

(51) Int. Cl.
*B65D 85/73* (2006.01)
*A47G 21/18* (2006.01)
*B65D 81/32* (2006.01)

(52) U.S. Cl.
CPC ..... *B65D 77/283* (2013.01); *B65D 81/32* (2013.01); *B65D 85/73* (2013.01); *B65D 2517/0049* (2013.01)

(58) Field of Classification Search
USPC ..... 220/706, 709, 707, 705, 906; 53/467, 53/476; 215/229, 389, 388
See application file for complete search history.

(56) References Cited

U.S. PATENT DOCUMENTS

| | | | | |
|---|---|---|---|---|
| 5,054,639 | A | 10/1991 | Ahn | |
| 5,431,297 | A | 7/1995 | Rosello | |
| 5,609,038 | A | 3/1997 | Halimi | |
| 5,819,979 | A | 10/1998 | Murphy et al. | |
| 6,264,057 | B1 | 7/2001 | Kim | |
| 7,516,869 | B1 | 4/2009 | Hajianpour | |
| 2001/0054618 | A1* | 12/2001 | Ferrari ..... | B65D 17/165 220/706 |
| 2010/0051629 | A1 | 3/2010 | Ravello et al. | |

FOREIGN PATENT DOCUMENTS

| | | | |
|---|---|---|---|
| CN | 1244848 | | 2/2000 |
| EP | 0 673 855 | A2 | 9/1995 |
| EP | 0673855 | | 9/1995 |
| EP | 1073593 | | 2/2001 |
| EP | 1155629 | | 11/2001 |
| EP | 1572553 | | 9/2005 |
| EP | 2128039 | | 12/2009 |
| EP | 2215936 | | 8/2010 |
| FR | 807033 | | 12/1936 |
| FR | 1 246 318 | A | 11/1960 |
| FR | 1246318 | | 11/1960 |
| FR | 2 579 959 | A1 | 10/1986 |
| FR | 2579959 | | 10/1986 |
| JP | 2009-132433 | | 6/2009 |
| WO | WO 2008/072060 | | 6/2008 |
| WO | WO 2008/072060 | A1 | 6/2008 |
| WO | WO 2010/029443 | | 3/2010 |
| WO | WO 2010/101389 | | 9/2010 |
| WO | WO 2010/130858 | | 11/2010 |
| WO | WO 2010/130858 | A1 | 11/2010 |
| WO | WO 2011/107123 | | 9/2011 |
| WO | WO 2011/107123 | A1 | 9/2011 |
| WO | WO 2014/009136 | | 1/2014 |
| WO | WO 2014/009138 | A2 | 1/2014 |

OTHER PUBLICATIONS

Written Opinion (with Englilsh translation) for International (PCT) Patent Application No. PCT/EP2014/066602, mailed Jan. 22, 2015, 18 pages.

International Preliminary Report on Patentability (with English translation) for International (PCT) Patent Applicationn No. PCT/EP2014/066602, mailed Mar. 15, 2016, 20 pages.

International Search Report and Written Opinion prepared by the European Patent Office dated Jan. 12, 2015, for International Application No. PCT/EP2014/066602.

English Translation of Official Action for China Patent Application No. 201480050618.7, dated Mar. 2, 2017, 9 pages.

* cited by examiner

CONTAINER CAN AND HOLDING DEVICE

CROSS REFERENCE TO RELATED APPLICATIONS

This application is a national stage application under 35 U.S.C. 371 and claims the benefit of PCT Application No. PCT/EP2014/066602 having an international filing date of Aug. 1, 2014 which designated the United States, which PCT application claimed the benefit of German Patent Application No. 20 2013 008 357.3 filed Sep. 13, 2013, the disclosures of each of which are incorporated herein by reference.

The invention relates to a container can that is sealed through placement of a lid after being filled.

The invention further relates to a holding device to be introduced into an initially open container can that is sealed through placement of a lid after being filled.

Furthermore, a method for providing a container can that is sealed through placement of a lid after being filled is described.

Container cans of the type mentioned at the outset are, for example, beverage can bodies, preferably made of metal, that are closed through placement of a beverage can lid after being filled with a beverage, preferably by creating a flanged seam between beverage can body and can lid.

A lid for sealing the container can is preferably embodied so as to be opened by a user, for example using an opening element. The lid can essentially be opened completely or only in a portion, as is the case with drinking openings of beverage cans, for example, which are opened by the user by removing a tab.

Besides the basic function of constituting a container that can be sealed through placement of a lid, it is preferred in various applications to provide additional features or characteristics of the container can that can simplify the use thereof or influence a product or medium arranged in the container can.

It is known, for example, from AT 502 989 B1, AT 10 442 U2, EP 2 215 936 A1, EP 2 128 039 A1, US 2001/0054618 A1, US 2010/0051629 A1, U.S. Pat. Nos. 7,516,869 B1, 6,264,057 B1, 4,892,187, 5,431,297, 4,356,927, 5,819,979, 5,054,639, JP 2009-132433, WO 2010/029443 A2, WO 2001/101389 A1 and WO 2008/072060 A1 to arrange a drinking straw in a beverage container. It is also known from EP 1 073 593 B1 , EP 1 155 629 B1 and EP 1 572 553 B1 to provide an optionally pressure-activatable container for receiving an addition, for example a liquid, optionally with dissolved gas, in a beverage can, whereby the addition is mixed into a main beverage liquid upon opening of the beverage can.

However, these solutions have various drawbacks; particularly, the handling and filling process of the container can is impaired, the manufacturing process of a container becomes more complex and time- and cost-intensive, and the solutions often do not yield the desired result.

It is therefore an object of the present invention to provide a container can of the type mentioned at the outset that reduces or eliminates one or more of the abovementioned drawbacks. It is also an object of the present invention to provide a holding device of the type mentioned at the outset that reduces or eliminates one or more of the abovementioned drawbacks. It is another object of the invention to provide a method of the type mentioned at the outset that reduces or eliminates one or more of the abovementioned [drawbacks].

This object is achieved by a container can that is sealed through placement of a lid after being filled and has a bottom, a peripheral wall that adjoins the bottom, and a narrowed end on an end facing away from the bottom, characterized in that a two-part holding device is located in the container can that has a second part and a first part detachably connected thereto, of which the first part has a connecting section for connecting the second part to the first part as well as a plurality of support arms, at least two upper support arms of which are designed to be supported on the peripheral wall of the container can in the region of the narrowed end and at least two lower support arms of which are designed to be supported on the peripheral wall of the container can in a place that is nearer to the bottom of the container can than the connecting section is.

The lower support arms have the particular advantage of stabilizing the first part upon detachment of the connection with the second part and preventing or reducing tilting of the first part in order to avoid interference with the second part floating upward or to have as little interference as possible.

Preferably, the second part has three lower support arms. Furthermore, it is preferred that the second part have three upper support arms. This kind of three-fold support is especially advantageous for achieving sufficient stability.

In another preferred embodiment, the upper and/or the lower support arms of the first part extend substantially parallel to a longitudinal axis of the container can.

The upper and/or the lower support arms of the first part preferably each have a first end that is arranged on the connecting section and a second end that is supported on the peripheral wall of the container can or at least comes very close to the peripheral wall. It is preferred that the second ends of the upper and/or lower support arms point radially slightly outward in relation to the respective first ends. In particular, it is preferred that the second ends of the upper and/or lower support arms of the first part each have at least one region that is arched radially outward. The connecting section of the first part is preferably annular.

The second ends of the upper and/or of the lower support arms can also preferably widen in the circumferential direction of the can and be embodied in the manner of a ring segment, for example.

One preferred embodiment is characterized in that the holding device is arranged and embodied such that, upon placement of a lid onto the initially open container can, it is changed from a first state to a second state.

The invention is based, among other things, on the insight that a holding device can be introduced into the initially open container can that only goes from a first to a second state when the container can is sealed through placement of a lid. This offers the advantage that, during the manufacture, handling and filling of the open, still-unsealed container can, the holding device is in the first state. This first state is referred to in this description as the passive state, and the second state as the active or activated state. The transition from the first, passive state to the second, active state is referred to here as activation. According to the invention, the activation of the holding device is thus triggered by the placement of a lid onto the container can.

In particular, it is preferred that a holding device be located in the container can that is formed by two parts that are detachably interconnected and arranged and embodied such that at least one of the two parts comes into contact with the lid upon placement of a lid onto the initially open container can such that at least one section of the connection between the two parts is detached.

This is based, among other things, on the insight that a holding device can be introduced into the initially open container can whose two parts detach from one another only when the container can is sealed through placement of a lid. This offers the advantage that, during the manufacture, handling and filling of the open, still-unsealed container can, the holding device is in a first state in which the two parts are interconnected. In this description, the first state is referred to as the passive state, and the second state, in which at least a section of the connection between the two parts of the holding device is separated, is referred to as the active or activated state. The transition from the passive state to the active state is referred to here as activation.

Preferably, the activation of the holding device is thus triggered by the placement of a lid onto the container can. During the process of filling the container can with a filling medium, for example a beverage, the two parts of the holding device are detachably interconnected. In this interconnected state of the two parts, at least one of the two parts comes into contact with a lid upon placement of the lid on the initially open container can.

For example, the lid can be embodied as a can lid for a beverage can and have a circumferential core crimp that protrudes farthest into the interior of the container can compared to the other regions of the can lid during and after placement onto a container can. Contact can thus be provided between the holding device and the side of the core crimp facing toward the container can. However, it is also possible for other regions of a beverage can lid, preferably those that are facing toward the interior of the container can, to trigger activation of the holding device upon contacting same.

Preferably, the activation of the holding device therefore occurs only upon sealing of the container can after a filling operation. That is, the holding device located in the container can is in the passive state before sealing of the can through placement of a lid. In the passive state, the holding device is preferably embodied such that a manufacturing, handling or filling operation involving the container can is not impaired by the holding device, or is only impaired to an insignificant extent.

In the passive and/or active state, the holding device is preferably rotationally symmetrical. One or both parts of the holding device can preferably have a recess for receiving another element, for example a drinking straw, and/or a reservoir for receiving a substance. In the interconnected state, both parts of the holding device are preferably arranged such that one of the two parts can be regarded as facing toward the closed bottom of the container can and the other part as facing toward the open end of the container can.

One preferred embodiment of the container can is characterized in that the holding device has a shape in the first state that limits a movement between holding device and container can, preferably a translational movement in the axial direction.

One preferred embodiment of the container can is characterized in that the holding device has a shape in the interconnected state that limits a movement between holding device and container can, preferably a translational movement in the axial direction.

In the passive state, the holding device is preferably embodied such that it is not freely movable in the still-open container can; rather, the movement of the holding device relative to the container can is limited. Particularly, it is preferred that a displacement of the holding device along a longitudinal axis or a rotational axis of a preferably rotationally symmetrical container can is possible only within certain limits or is not possible at all, so that the holding device is prevented from falling out of the still-open container can. In the case of beverage cans, this can be achieved, for example, by providing the holding device at least in sections with a larger diameter than the open end of the container can, which is preferably narrowed in comparison to the rest of the beverage can body. The holding device can have one or more sections that are supported on the interior of the container can in this narrowed region at the open end of the container can.

This kind of embodiment is especially preferred, since it makes it possible to handle the container can in any manner in the open state with the holding device inserted, that is, even upside down, for example—i.e., with the open end of the container can pointing substantially downward—without the holding device arranged in the still-open container can falling out. For this purpose, the holding device can preferably have about the same extension in the direction of a longitudinal axis of the container can as the container can. For example, the holding device can abut with one of the two parts against the closed bottom of the container can and with the other of the two parts against the open end of the container can, which is preferably slightly conically narrowed. Particularly, the part of the holding device that preferably abuts against the open end of the container can be biased such that this part is supported on the open end of the container can, particularly on the narrowed region.

This kind of upside-down orientation of the container can is provided, for example, for beverage can bodies during the washing process, in which a wall-ironing means used for the shaping of the can is removed by transporting the beverage can bodies upside down through several washing chambers in which the outsides of the cans arranged from above and the insides of the cans arranged from below are rinsed with water. It is advantageous if the holding device is already in the can during the washing process, since it can thus be ensured, particularly when using the container can for foodstuffs, that the holding device, which also comes into contact with the contents to be consumed during the filling of the container can, was rinsed beforehand and therefore has the same hygienic characteristics as the interior of the container can.

Furthermore, the holding device is immovable translationally in a radial direction in the passive state or is at least limited, thus maintaining a preferably substantially concentric arrangement on the interior of the container can.

One preferred embodiment is characterized in that the connection between the two parts of the holding device is an integral connection, so that the two parts are integrally formed in the connected state, and preferably fails at a predetermined breaking point between the two parts upon placement of a lid onto the initially open container can.

An integral design of the holding device in the passive state has the advantage that no separate parts need to be manufactured and assembled. To separate a section of the connection between the two parts, a predetermined breaking point is preferably provided, for example a material weakening or a geometrical change, so that the integral connection of the initially one-piece holding device is separated in a certain region. The integral connection between the two parts of the holding device can also be separated completely so that a connection no longer exists between the two parts in the activated state.

One alternative embodiment is characterized in that the connection between the two parts of the holding device is a mechanical connection.

Alternatively to the initially integral design, the holding device can also consist of two mechanically connected parts. This is advantageous if the two parts are made of different materials, for example, and/or are to be manufactured using different manufacturing methods.

Preferably, the mechanical connection is a plug, clamp or snap connection.

Another preferred embodiment is characterized in that the connection can be detached through a movement of both parts of the holding device relative to each other in the direction of a longitudinal axis of the container can.

In this embodiment, the activation of the holding device occurs as a result of a movement between the two parts substantially along a longitudinal axis of the container can, i.e., in the axial direction. This embodiment is independent of the type of connection of the parts, i.e., it is applicable both to the independent connection and to the mechanical connection of the two parts in the passive state.

In the case of rotationally symmetrical container cans, the longitudinal axis preferably corresponds to the rotational axis. A relative axial movement of the two parts is preferred for activation, since this can be achieved especially easily if a lid is placed onto the initially open container can and contact occurs between holding device and lid.

Furthermore, it is especially preferred for the two parts of the holding device to be arranged in the interconnected state such that pressure is applied in the axial direction onto the holding device upon placement of a lid onto the initially open container can.

It is preferred that this kind of pressure be applied to at least one of the two parts in the direction of the longitudinal axis so that at least one section of the container can between the two parts is separated, i.e., the holding device is activated. This can be achieved, for example, by having the dimension of the holding device in the direction of the longitudinal axis of the container can be longer in the passive state than a distance between the closed bottom of the container can and the surface of the lid facing toward the interior of the container can after the lid has been sealed with the container can [sic]. As a result, less space is available in the axial direction for the holding device after the closing of the container can than before it was closed. Through the placement of the lid, axial pressure is thus applied to the holding device, which preferably leads to the activation of the retaining element, which can be achieved, for example, through a relative movement of the two parts.

In particular, it is preferred that an underside of the core crimp facing toward the interior of the container can comes into contact with part of the holding device upon placement of the lid, since the underside of the core crimp of a can lid usually protrudes farthest into the interior of the container can compared to the other regions of the can lid and thus most greatly reduces the space available for the holding device in the axial direction.

Another preferred embodiment is characterized in that one of the two parts or both parts of the holding device has or have support arms that are shaped such that the support arms or at least a respective section of the support arms abut against a peripheral wall of the container can or at least come very close to the peripheral wall.

These support arms are preferably embodied and arranged such that they come into contact with a peripheral wall, i.e., the cylindrical part of the interior of the container can, the closed bottom of the container can, or a narrowed region at the open end of the container can or are very close to the peripheral wall. Preferably, the support arms are biased outward in the radial direction, so that they can be pressed far enough together counter to the direction of bias that they can be introduced through the open end of the container can into the interior of the container can and move far enough radially outward again in the interior of the container can as a result of the bias that they come into contact with the peripheral wall or are not far from same. In this way, it can be achieved that the holding device can easily be introduced into the container can but remains inside it, for example even when the open container can is handled upside-down. This design of the support arms can be provided only in one or in both parts of the holding device. Particularly, this design of the support arms is preferred in the part of the holding device that faces toward the open end of the container can.

The support arms of one or both parts of the holding device preferably extend substantially along the longitudinal axis of a container can. If both parts have support arms, then they preferably extend in the opposite direction substantially parallel to the longitudinal axis of a container can, and its common overall extension preferably corresponds approximately to the extension of the container can along its longitudinal axis.

Another preferred embodiment is that each of the two parts has a connecting section on which the support arms are arranged, with the two parts being arranged in the connected state in such a way that the support arms of the first part extend beyond the connecting section of the second part in the axial direction and the support arms of the second part extend beyond the connecting section of the first part, with the connecting sections preferably being detachably interconnected.

In this embodiment, the two parts of the holding device can be embodied as follows, for example: Each of the two parts has a connecting section to which the respective support arms are connected with a first end, preferably in an integral manner, and from which the support arms each extend substantially parallel to the longitudinal axis of the container can. The second ends of the support arms preferably point slightly radially outward compared to the first ends of the support arms connected to the connecting section. Alternatively, the connecting section of at least one part can also extend substantially over the entire cross section of the interior of the container can, so that the support arms extend from there in the vicinity of the peripheral wall of the container can substantially parallel to the longitudinal direction.

One or both connecting sections can preferably be circular, annular or star-shaped.

When the holding device is in the passive state, the connecting sections of both parts are arranged directly adjacent to one another, with the support arms of each part extending beyond the connecting section of the other part, and both connecting sections being detachably interconnected. In the activated state, it is preferred that the two connecting sections be detached from one another and that they separate from each other, preferably through a translational movement substantially along the longitudinal axis of the container can of at least one of the two parts.

It is especially preferred for a recess for receiving another element, such as a drinking straw, for example, to be arranged in the connecting section of one of the two parts.

Another preferred embodiment is a reservoir arranged on one of the two parts, with the detachment of at least one section of the connection between the two parts bringing about the release of a substance from the reservoir. In this embodiment, a substance that is arranged in a container or reservoir is released through the activation of the holding device, the container or reservoir being sealed in the passive state of the holding device but opened upon activation of the holding device. This substance can preferably bring about a change or improvement of the medium—a beverage, for example—arranged in the filled and sealed container can. This kind of effect can involve the visual appearance, the taste and/or the consistency of a medium, for example.

Another preferred embodiment is characterized in that at least one of the two parts is formed such that it can be moved relative to the container can upon disconnection.

In the activated state, one of the two parts is preferably movable in relation to the container can, that is, it can move in the interior of the container can, thus enabling movement only within the limits of the container can. Mobility along the longitudinal axis of the container can and/or rotationally about the longitudinal axis of the container can is particularly preferred. Preferably, however, the movable part has no or at least limited translational mobility in the radial direction, so that it maintains a substantially concentric arrangement in the interior of the container can even in the activated state.

After the activation of the holding device, it is also possible for both parts to be movable is relative to the container can.

In particular, it is preferred that the movable part have a lower density than the filling medium with which the container can is filled during a filling operation.

The density of the movable part is preferably adapted to the filling medium such that the movable part floats upward in the filling medium. It is thereby achieved that, when the holding device is in the passive state, i.e., when the two parts are interconnected, the holding device does not float in the still-open can, but rather is impeded from moving translationally along the longitudinal axis of the container can as a result of the abutment of support arms on the narrowed open end of the container can, for example. After the activation of the holding device and the detachment of the connection between the two parts, the movable part can then float preferably substantially along the longitudinal axis of the container can.

In an especially preferred embodiment, a drinking straw is arranged on the movable part. Preferably, this drinking straw is firmly connected to the movable part, so that the drinking straw moves along with the movable part. Preferably, the drinking straw is arranged on the movable part and the enlargement for receiving the drinking straw is arranged on the part such that, upon opening the can, the movable part floats upward with the drinking straw such that the drinking straw is guided through a drinking opening of the beverage can.

After the activation of the holding device through placement of the lid, the movement of the movable part can preferably also be inhibited by another element, for example a drinking straw. If the drinking straw is arranged on a part of the holding device such that it projects axially over in the direction of the can lid, the movable part cannot float when the beverage can is closed despite its low density, since the drinking straw abuts against the can lid, thus preventing an upward movement of the movable part. When the beverage can is opened by the user, however, the drinking straw—in the corresponding arrangement—can emerge upward from the beverage can through the drinking opening, thus enabling the movable part to float up together with the drinking straw such that a user can consume the filling medium arranged in the beverage can, preferably a beverage, using the drinking straw.

In another preferred embodiment, a provision is made that the drinking straw has a drinking end that faces toward the lid and is closed in the axial direction of the drinking straw and has one, two or more radial openings. The drinking end of the drinking straw is the end that is arranged on the interior near the lid when the beverage can is closed, that emerges up out of the beverage can through the drinking opening when the beverage can is opened, and through which a consumer can consume the beverage. This drinking end is preferably closed in the axial direction, that is, no medium can get out at the drinking end in the longitudinal direction of the drinking straw and along its longitudinal axis. The drinking end can be sealed in the axial direction, for example by a rounded-off tip. However, in order to enable a consumer to remove medium or a beverage at the drinking end, one, two or more radial openings are provided at the drinking end. When seen from the longitudinal axis of the drinking straw, a radial drinking opening is an opening arranged in the radial direction in the side wall of the drinking straw and can also be referred to as a lateral opening. A radial opening can be round or oval-shaped, for example. An embodiment with two opposing radial openings is especially preferred. The advantage of such a drinking straw is that, particularly in carbonated beverages, it prevents an inadvertent spraying-out of the beverage in the axial direction from the drinking straw when opening the beverage can. By means of the radial opening, sufficient media flow from the drinking straw can be ensured, particularly in order to give the consumer an impression when drinking the beverage that is as similar as possible to the use of a conventional drinking straw with an axial opening.

According to another aspect of the invention, the object is achieved by a holding device (100) to be introduced into an initially open container can (200) that is sealed after being filled through placement of a lid (300), characterized in that the holding device (100) is embodied in two parts and has a second part (120) and a first part (110) detachably connected thereto, the first part (110) of which has a connecting section (111) for connecting the second part (120) to the first part (110), as well as a plurality of support arms, at least two of which are embodied as upper support arms (112) and supported in the region of the narrowed end (203) on a peripheral wall (204) of the container can (200), and at least two of which are embodied as lower support arms (113) and are supported on the peripheral wall (204) of the container can (200) in a place that is nearer to the bottom (202) of the container can (200) than the connecting section (111) is.

The holding device can preferably be improved by being embodied such that, upon placement of a lid (300) onto the initially open container can (200), it is changed from a first state to a second state, with the two parts (110, 120) of the holding device (100) being arranged and embodied such that at least one of the two parts (110, 120) comes into contact with a lid (300) upon placement of the lid (300) onto an initially open container can (200) such that at least one section of the connection between the two parts (110, 120) is detached.

Another aspect of the invention relates to a drinking straw to be arranged on one of the two parts of the holding device described above, with the drinking straw having a drinking end that faces toward the lid, is closed in the axial direction of the drinking straw, and has one, two or more radial openings.

The container can according to the invention is preferably provided through a method for preparing a container can that is sealed after being filled through placement of a lid comprising the steps:

provision of an initially open container can (200) having a bottom (202), a peripheral wall (204) that adjoins the bottom, and a narrowed end (203) facing away from the bottom; arrangement of a two-part holding device (100) in the container can (200), the holding device (100) having a second part (120) and a first part (110) detachably connected thereto, the first part (110) of which has a connecting section (111) for connecting the second part (120) to the first part (110), as well as a plurality of support arms, at least two of which are embodied as upper support arms (112) and supported in the region of the narrowed end (203) on the peripheral wall (204) of the container can (200), and at least two of which are embodied as lower support arms (113) and are supported on the peripheral wall (204) of the container can (200) in a place that is nearer to the bottom (202) of the container can (200) than the connecting section (111) is; filling of the container can (200); and sealing of the container can (200) through placement of a lid (300).

The method can preferably be improved by making a provision that, upon sealing of the container can (200) through placement of the lid (300), the holding device (100) is changed from a first state to a second state, and that preferably at least one of the two parts (110, 120) of the holding device (100) comes into contact with the lid (300) such that at least a section of the connection between the two parts (110, 120) is detached.

The holding device according to the invention and the method with its respective modifications have features and method steps that render them particularly suitable for being used for a container can according to the invention and modifications thereof. As regards the advantages, variants of the embodiments and details of these other aspects and the respective modifications, reference is made to the preceding description and to the corresponding features of the container can.

The drinking straw according to the invention is preferably prepared using a method for introducing at least one radial opening into a previously-described drinking straw, with material of the drinking straw in the region of the radial opening to be produced being removed on a side of the peeling tool facing away from the drinking straw.

During the manufacture of a previously-described drinking straw with radial openings, for the sake of consumer safety, care must be taken to ensure that no residual materials get into the interior of the drinking straw. It was recognized that standard die cutting from the outside to the inside cannot be used to manufacture a drinking straw with radial openings, since the punching waste (also called scrap) cannot be reliably removed from the drinking straw. Furthermore, it was recognized that, while performing the die cutting in the opposite direction would propel the punching waste outward, this is not feasible due to the limited space within the drinking straw. A provision was therefore made to manufacture a drinking straw with at least one radial opening using a peeling process. A peeling tool is used for this purpose with which material is removed from the outer surface of the drinking straw in one or more peeling steps, thus resulting in an opening in the drinking straw as a result of this removal of material. The peeling tool is arranged such that it has a side facing away from the drinking straw (i.e., the interior of the drinking straw) and a side facing toward the drinking straw (i.e., the interior of the drinking straw). The peeling process occurs in such a way that material is removed using the peeling tool from the side facing away from the drinking straw, so that the peeling tool is located between the interior of the drinking straw and the material to be removed. In this way, the arrangement of the peeling tool prevents material to be removed (peeling waste) from getting into the interior of the drinking straw, since the resulting radial opening is covered by the peeling tool during peeling and the material removed during peeling falls outward. The peeling tool thus represents a kind of parting line between the radial opening of the drinking straw and the peeling waste.

A preferred embodiment of the invention is described for the sake of example with reference to the enclosed figures.

Figure 1:
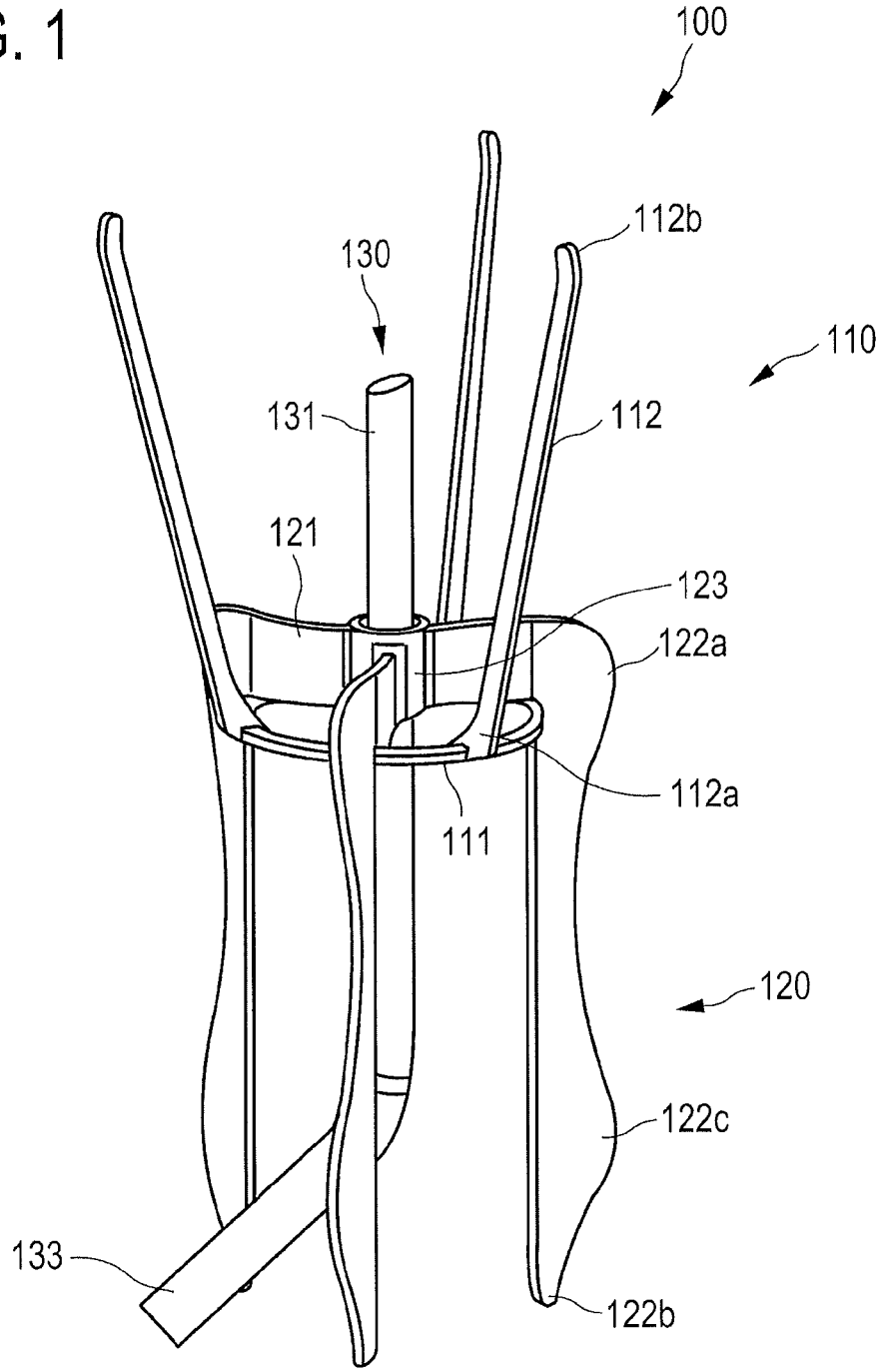
FIG. 1 shows an example of a holding device with a drinking straw.
Figure 2:
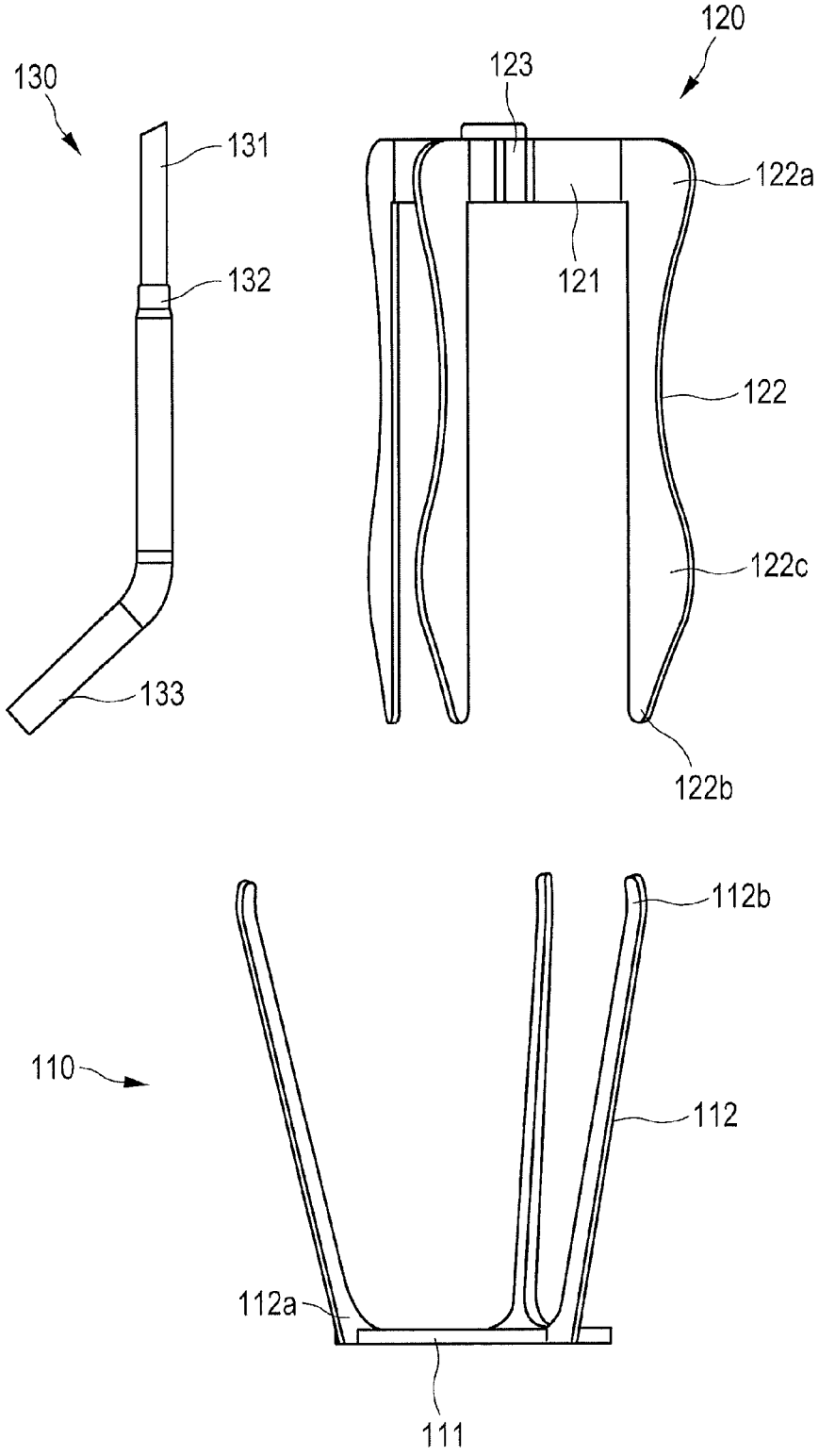
FIG. 2 shows the two parts as well as the drinking straw of the holding device depicted in FIG. 1 separately from each other.
Figure 3:
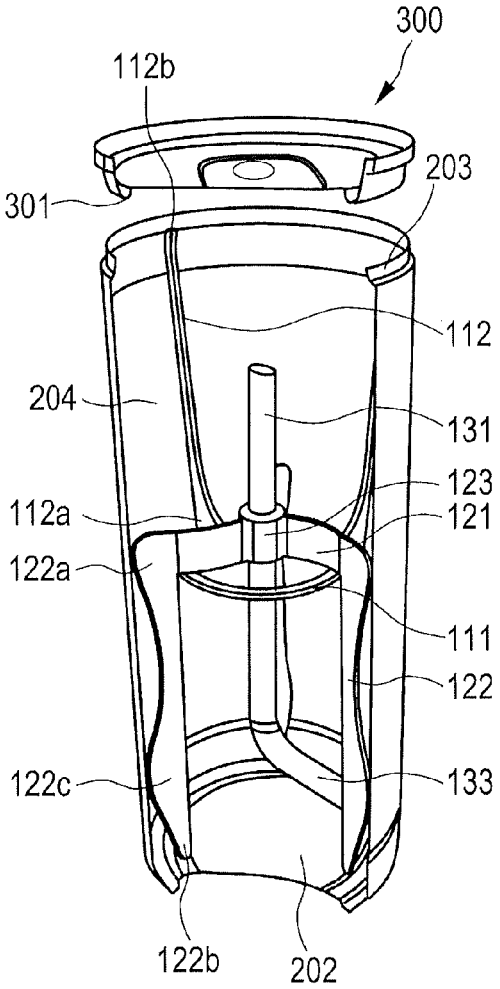
FIG. 3 shows the holding device according to FIG. 1 arranged in a container can with the lid not yet put in place.
Figure 4:
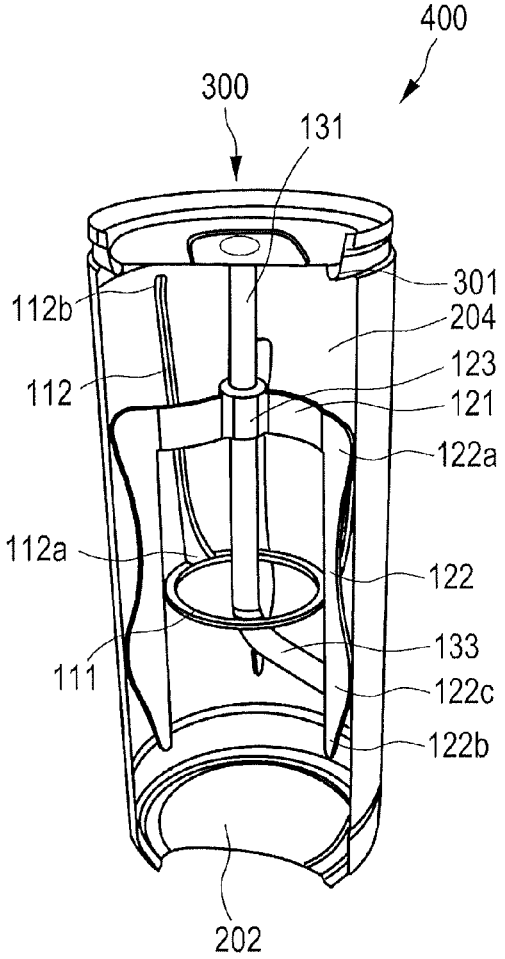
FIG. 4 shows the container can from FIG. 3 with lid in place.
Figure 5:
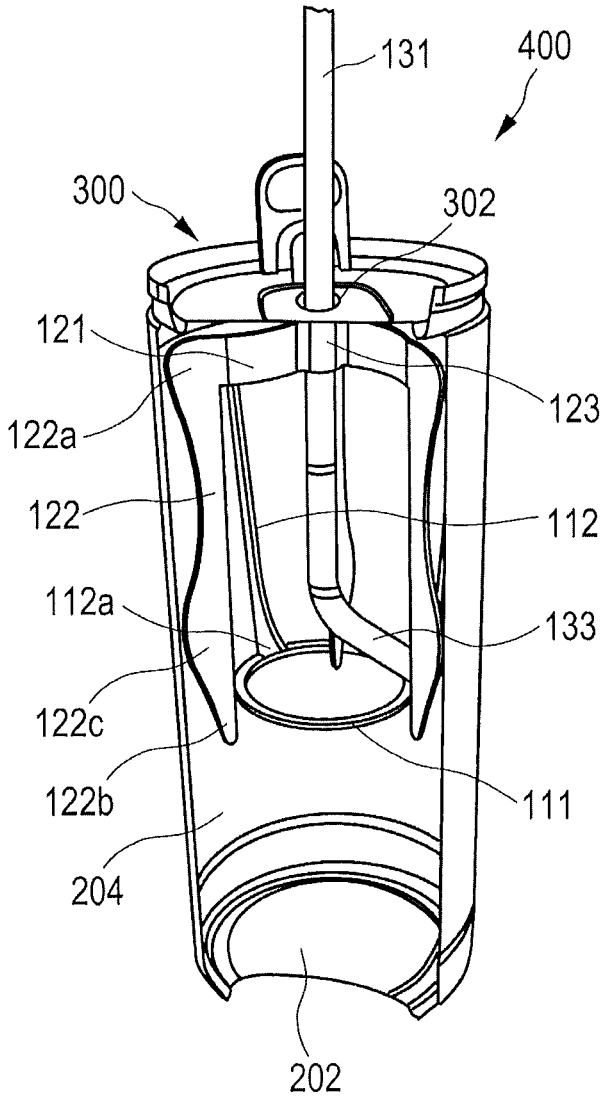
FIG. 5 shows the container can from FIG. 3 with lid in place according to FIG. 4 with opened drinking opening.

FIGS. 1 to 11 show a holding device 100 or parts thereof. As can be seen in FIGS. 3 to 5, the holding device 100 can be arranged in a container can 200. After being filled, the container can 200 is sealed into a beverage can 400 through placement of a lid 300.

The holding device 100 shown here is formed from two parts 110, 120 that are detachably interconnected. The connection between the two parts 110, 120 of the holding device 100 is a mechanical connection, preferably a snap-fit connection.

Same or substantially functionally equivalent elements are designated by the same reference symbols. In the case of slightly deviating elements, an apostrophe (') is appended to the same reference symbol.

Figure 8:
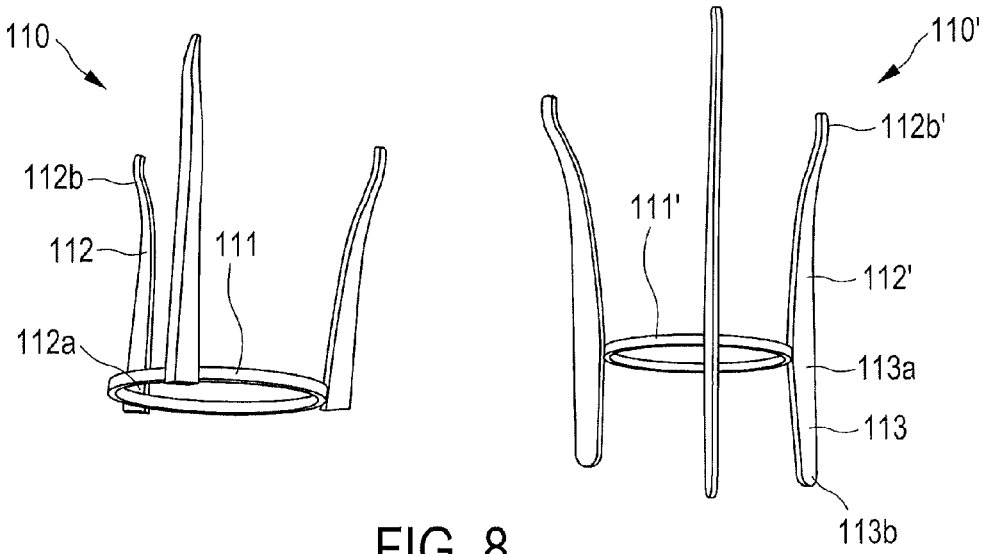
FIG. 8 shows three-dimensional views of two variants of a first part of a holding device.
Figure 11:
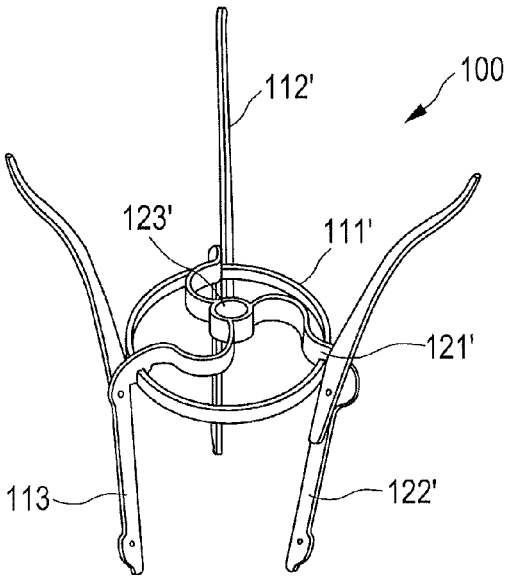
FIG. 11 shows a three-dimensional view of a variant of a holding device.
Figure 9:
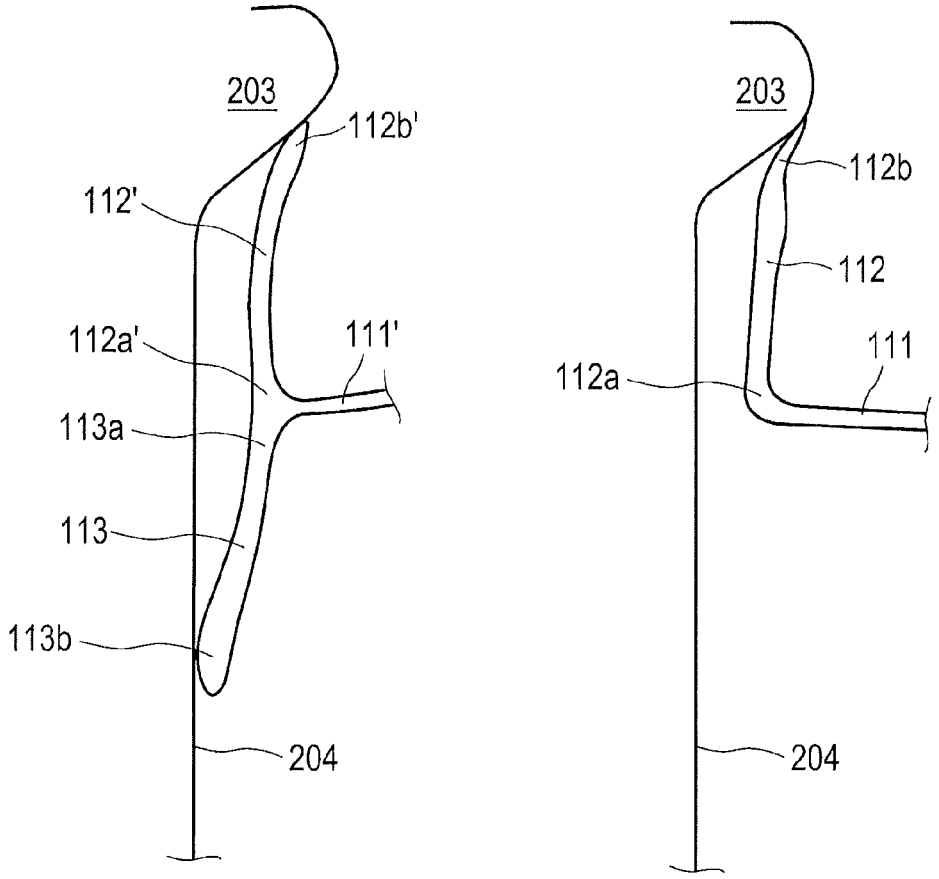
FIG. 9 shows schematic representations of two variants of a first part of a holding device.

In FIGS. 1 to 5 as well as in the variant to the left in FIG. 8 and in the variant to the right in FIG. 9, the first part 110 has only upper support arms 112. In FIG. 11 as well as in the variant to the right in FIG. 8 and in the variant to the left in FIG. 9, the first part 110' also has lower support arms 113 with first and second ends 113*a,b*. The lower support arms 113 have the particular advantage of stabilizing the first part 110' upon detachment of the connection with the second part 120, 120' and preventing or reducing the tilting of the first part 110' in order to not to interfere with the second part 120, 120' floating upward or to interfere with it as little as possible.

Figure 10:
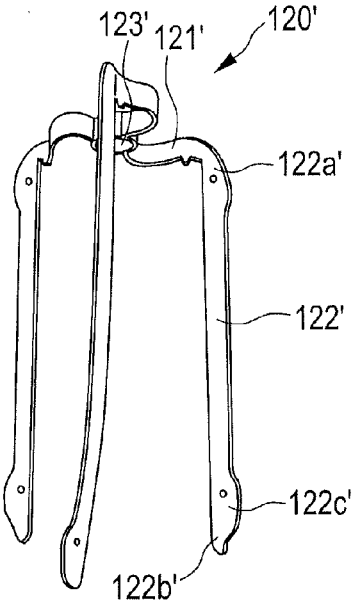
FIG. 10 shows a three-dimensional view of a variant of a second part of a holding device.

The second part 120' shown in FIGS. 10 and 11 is substantially functionally equivalent to the second part 120 shown in the other figures but has a slightly modified shape.

Each of the two parts 110, 120 has a connecting section 111, 121 on each of which three support arms 112, 122 are arranged. The support arms 112, 122 are shaped such that they abut against a peripheral wall 204 of the container can 200 or come very close to the peripheral wall 204. The first ends 112*a* of the support arms 112 of the part 110 are arranged on the connecting section 111. The connecting section 111 of the part 110 is annular. The second ends 112*b* of the three support arms 112 point slightly radially outward in relation to the first ends 112*a*, which are connected to the connecting section 111. The three support arms 112 of the first part 110 extend substantially parallel to the longitudinal axis of the container can 200. The support arms 112 rest with their second ends 112*b* against the peripheral wall of the container can in the region of the narrowed end 203.

The second part 120 also has a connecting section 121 and three support arms 122. The support arms 122 are attached with their first ends 122*a* to the connecting section 121 and extend along the longitudinal axis of the container can 200. The support arms 122 come very close to the peripheral wall 204 of the container can 200, particularly as a result of the outwardly bulging regions on the first end 122*a* and in the region 122*c*. The second ends 122*b* of the support arms 122 come into contact with the bottom 202 of the container can 200.

When the holding device 100 is in the connected state, the two parts 110, 120 are detachably interconnected at their connecting sections 111, 121. This passive state of the holding device is shown in FIGS. 1 to 3. In this state, the holding device 100 has an extension in the direction of the longitudinal or rotational axis of the container can 200 that corresponds substantially to the extension of the container can 200 along this direction. In the connected state, the two parts 110, 120 are arranged such that the support arms 112 of the first part 110 extend in the axial direction beyond the connecting section 121 of the second part 120 and the support arms 122 of the second part 120 extend beyond the connecting section 111 of the first part 100. The part 120 faces toward the closed bottom 202 of the container can, and the part 110 faces toward the open end 203 of the container can 200.

The connecting section 121 of the second part 120 has a recess 123 for receiving a drinking straw 130. The drinking straw is attached with its section 132 to the receptacle 123 of the part 120, for example through a frictional connection. A section 131 of the drinking straw 130 protrudes axially in the direction of the can lid 300 and the open end 203 of the container can 200 over the connecting section 121 of the part 120. Another section 133 of the drinking straw extends in the direction of the bottom 202 of the container can 200 and can preferably be angled with respect to the other sections of the drinking straw 130.

Preferably, the support arms 112, and particularly the ends 112*b* thereof, are biased such that, in the state shown in FIG. 1, the outer periphery around the three second ends 112*b* of the support arms 112, particularly a maximum outer periphery, is greater than the minimum circumference of the container can 200 at its narrowed open end 203. Upon introduction of the holding device 100 into the container can 200, the support arms 112 can then preferably be pressed together radially inward such that they can be introduced through the slightly conically narrowed end 203 of the container can 200 into the interior of the container can 200 and then move again slightly radially outward as a result of the biasing and rest against the conically narrowed end 203 of the container can 200. The shape of the second ends 112*b* of the support arms 112 is preferably adapted for this purpose to the conical shape of the narrowed end 203 of the container can 200.

In the connected state, the holding device 100 has a shape that limits a translational movement between the holding device 100 and the container can 200 in the axial direction. In the exemplary embodiment depicted here, this is achieved by virtue of the fact that, on the one hand, the second ends 112*b* of the support arms 112 abut against the narrowed open end 203 of the container can 200 from the inside and, on the other hand, the second ends 122*b* of the support arms 122 are arranged on or near the bottom 202 of the container can 200. In this way, the container can 200 can also be handled upside down, for example during a washing operation, without the possibility of the holding device 100 falling out of the open container can 200.

The shape of the holding device 100 further prevents or limits a translational movement in the radial direction relative to the container can 200, whereby the holding device 100 maintains a substantially concentric arrangement on the interior of the container can 200. In the present exemplary embodiment, the star-shaped design of the connecting section 121 of the second part 120 and the biasing of the support arms 112 of the first part 110 contribute particularly to this.

The container can 200 with inserted holding device 100 is preferably filled with a beverage or another medium before a lid 300 is placed onto the open container can 200 and connected with the open, narrowed end 203 of the container can 200 through the creation of a flanged seam to form a closed beverage can 400. Upon placement of the lid 300 onto the initially open container can 200, the part 110, particularly the second ends 112*b* of the support arms 112, comes into contact with a core crimp 301 of the lid such that the snap-fit connection between connecting sections 111, 121 is detached.

The snap-fit connection between the two connecting sections 111, 121 is detached through a movement of the two parts 110, 120 relative to one another in the direction of a longitudinal axis of a container can 200. This relative movement is produced through pressure in the axial direction toward the holding device 100 that is applied to the holding device 100 upon placement of the lid 300. This pressure results from the fact that the core crimp 301 of the lid 300 protrudes into the interior of the container can 200 during and after placement of the lid 300 onto the container can 200. The available space for the holding device 100 in the axial direction is limited, whereby the core crimp 301, upon contacting the second ends 112*b* of the support arms 112 of the part 110, exerts pressure substantially in the axial direction onto the holding device 100, thus triggering the snap-fit connection between the connecting parts 111, 121 and activating the holding device 100.

The activated state of the holding device 100 is shown in FIGS. 4 and 5, which differ from each other in that the lid 300 is closed in FIG. 4, and a drinking opening 302 of the lid 300 is open in FIG. 5 so that the drinking straw 130 can emerge from the drinking opening 302 with its section 131. Both parts 110, 120 are freely movable in principle as a result of the detachment of the connection between them, that is, they are movable on the interior of the beverage can 400 relative to one another and relative to the beverage can 400 within the limits that are established by the container can 200 closed with a lid 300.

In the situation shown in FIG. 4, however, the second part 120 is still particularly limited in its translational movement substantially parallel to the longitudinal axis of the beverage can 400, since the section 131 of the drinking straw 130 projects in the direction of the lid 300 beyond the connecting section 121 of the part 120, abuts against the closed lid 300, and thus prevents or limits movement of the part 120 in the direction of the lid 300.

The part 120 has a lesser density than a filling medium, for example a beverage, with which the container can 200 is filled during a filling operation. In particular, the density of the part 120 is adapted to the filling medium such that the part 120 floats upward in the filling medium even with the drinking straw 130 attached to the connecting section 121.

If the closed beverage can 400 is now opened by a user, for example by actuation of an opening element, and the drinking straw 130 is arranged so as to fit into a drinking opening 302 in the lid 300, the first section 131 of the drinking straw 130 can pass through the drinking opening 302 in the lid 300 and therefore no longer prevents the translational movement of the part 120 relative to the beverage can 400, so the part 120 can float upward in the beverage can 400 together with the drinking straw 130 attached thereto and the section 131 of the drinking straw 130 can emerge from the beverage can 400, as shown in FIG. 5.

Figure 6:
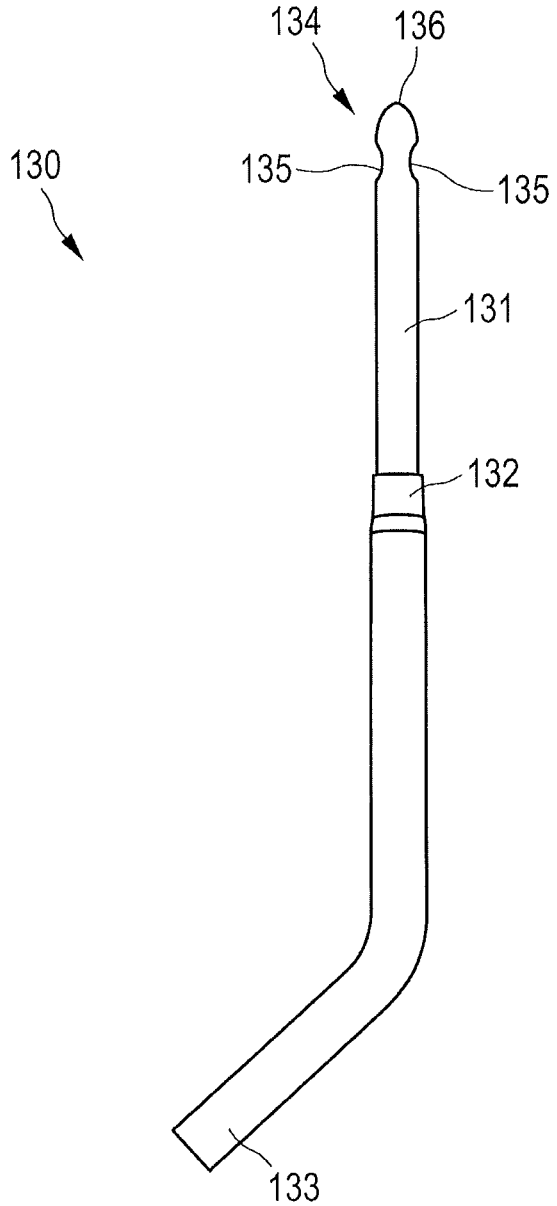
FIG. 6 shows a side view of a preferred exemplary embodiment of a drinking straw for a holding device.
Figure 7:
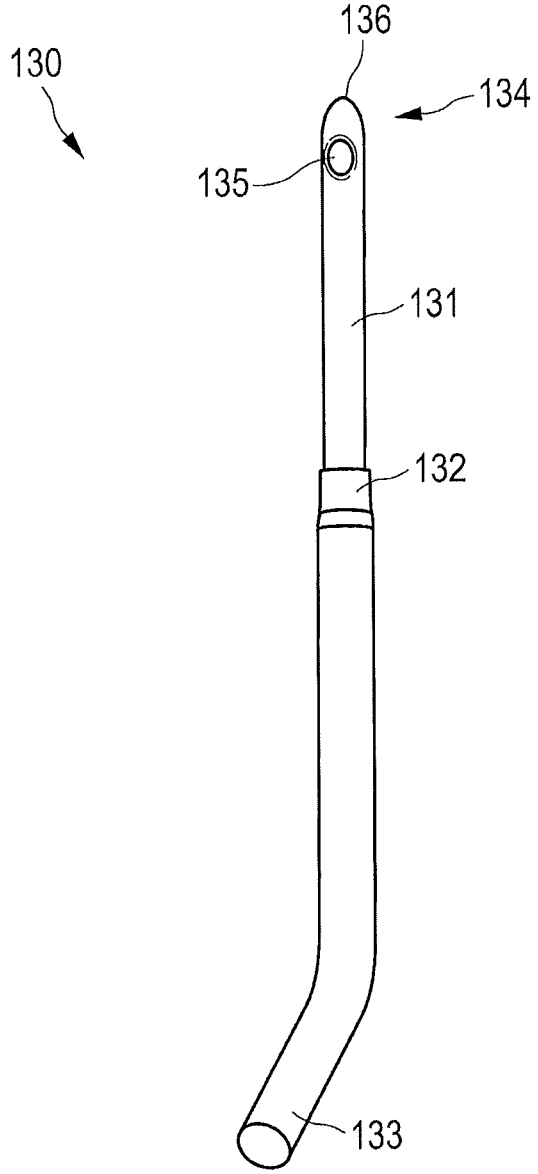
FIG. 7 shows a three-dimensional view of the drinking straw according to FIG. 6.

FIGS. 6 and 7 show a preferred exemplary embodiment of a drinking straw 130 for a previously-described holding device in a previously-described beverage can. This drinking straw 130 in FIGS. 6 and 7 is characterized in that in that the drinking end 134 is closed in the axial direction of the drinking straw by a rounded-off tip 136 and has two radial openings 135. The drinking end 134 is the end of the drinking straw 130 that is arranged on the section 131 of the drinking straw 130 and, in the state in which it is in a closed beverage can, is arranged near the lid. When the beverage can is opened, the drinking end 134 passes upward through a drinking opening and out of the beverage can, so that a consumer can consume the beverage through the radial openings 135.

As a result of the closure of the drinking end 134 in the axial direction by means of the rounded-off tip 136, no medium is able to escape, so inadvertent spraying-out of the beverage in the axial direction out of the drinking straw 130 can be prevented, particularly when opening a can with a carbonated beverage.

The two radial and lateral drinking openings 135 oppose one another and are oval-shaped. When seen from the longitudinal axis of the drinking straw 130, they are openings arranged in the radial direction in the side wall of the drinking straw 130. A consumer is able to reliably and easily drink a beverage through the radial openings 135.

What is claimed is:

1. A container that is sealed through placement of a lid after being filled, the container comprising:

a bottom, a peripheral wall that adjoins the bottom, and a narrowed end on one end facing away from the bottom;

a holding device provided in the container, the holding device comprising a first part and a second part, the first part being detachably connected to the second part;

wherein the first part comprises a connecting section for connecting the second part to the first part, and a plurality of support arms;

wherein at least two of the plurality of support arms of the first part comprise upper support arms operable to be supported on the peripheral wall of the container; and wherein the second part comprises a connecting section and at least two support arms that comprise lower support arms operable to be supported on the peripheral wall of the container, and wherein the at least two support arms of the second part extend downwardly from the connecting section of the second part toward the bottom of the container.

2. The container of claim 1, wherein the second part comprises three lower support arms.

3. The container of claim 1, wherein the second part comprises three upper support arms.

4. The container of claim 1, wherein the support arms of the first part extend substantially parallel to a longitudinal axis of the container.

5. The container of claim 1, wherein the support arms of the first part each have a first end that is arranged on the connecting section of the first part and a second end that is supported on the peripheral wall of the container, and wherein the second ends of the support arms extend radially outward in relation to the respective first ends.

6. The container of claim 5, wherein the second ends of the support arms of the first part each have at least one region that is arched radially outward.

7. The container of claim 1, wherein the connecting section of the first part is annular.

8. The container of claim 1, further comprising a lid operable to contact and displace the first part when the lid is provided in an assembled state with the container.

9. The container of claim 8, wherein the first part and the second part are arranged such that at least one of the first part and the second part comes into contact with the lid upon placement of the lid onto an initially open container, and wherein the lid is operable to detach a connection between the first part and the second part.

10. The container of claim 1, wherein a detachable connection is provided between the first part and the second part of the holding device, wherein the detachable connection comprises a predetermined breaking point between the first part and the second part, and wherein placement of a lid onto the initially open container is operable to detach the first part and the second part at the predetermined breaking point.

11. The container of claim 10, wherein the detachable connection can be detached through a movement of both parts of the holding device relative to each other in the direction of a longitudinal axis of the container.

12. The container of claim 1, wherein a connection between the first part and the second part of the holding device is a mechanical connection comprising at least one of a plug, a clamp and a snap connection.

13. The container of claim 1, wherein the first part and the second part of the holding device are arranged in an interconnected state such that pressure is applied in the axial direction onto the holding device upon placement of a lid onto the container.

14. The container of claim 1, wherein the support arms of the second part abut against a peripheral wall of the container.

15. The container of claim 1, wherein the support arms of the first part extend beyond the connecting section of the second part in the axial direction and the support arms of the second part extend beyond the connecting section of the first part, and wherein the connecting sections are detachably interconnected.

16. The container of claim 1, wherein at least one of the first part and the second part comprises a reservoir, and wherein a detachment of first part and the second part causes the release of a substance from the reservoir.

17. The container of claim 1, wherein at least one of the first part and the second part is formed such that at least one of the first part and the second part can be moved relative to the container upon disconnection of the first part and the second part.

18. The container of claim 17, wherein the part that can be moved has a lower density than a filling medium with which the container is filled during a filling operation.

19. The container of claim 17, wherein a drinking straw is arranged on the part that can be moved.

20. The container of claim 19, wherein the drinking straw has a drinking end that faces toward a lid and is closed in the axial direction of the drinking straw and has at least one radial opening.

21. A holding device to be introduced into an initially open container can that is sealed after being filled through placement of a lid, the holding device comprising:

a first part and a second part, wherein the first part and the second part are detachably connected, the first part comprising a connecting section for connecting the second part to the first part, and a plurality of support arms, wherein at least two of the support arms comprise upper support arms operable to be supported on a peripheral wall of a container can, and wherein the second part comprises a plurality of support arms comprising lower support arms operable to be supported on the peripheral wall of the container can proximal to a bottom of the container can.

22. The holding device as set forth in claim 21, wherein the holding device is displaceable between a first state and a second state upon placement of a lid onto the initially open container can, wherein the first part and the second part of the holding device are arranged in a first position such that at least one of the two parts comes into contact with the lid upon placement of the lid onto the initially open container can, and wherein the contact with the lid is operable to disconnect the first part and the second part.

23. The holding device according to claim 21, further comprising a drinking straw arranged on at least one of the first part and the second part, and wherein the drinking straw has a drinking end and that is closed in an axial direction of the drinking straw and has one, two or more radial openings.

* * * * *